United States Patent [19]

Lowell

[11] 4,122,230

[45] Oct. 24, 1978

[54] FLASHING ARTICLE COMPRISING A CHLORINATED POLYETHYLENE LAYER ADHERED TO AN ASPHALT-SATURATED FELT LAYER PRODUCED BY JOINING THE TWO LAYERS UNDER PRESSURE AT ELEVATED TEMPERATURE

[76] Inventor: Ben T. Lowell, 4728 Brafferton Rd., Bloomfield Hills, Mich. 48013

[21] Appl. No.: 789,806

[22] Filed: Apr. 22, 1977

[51] Int. Cl.[2] ..... B32B 11/04; D06N 5/00; E04D 13/04; E04D 13/08

[52] U.S. Cl. ..... 428/280; 52/11; 52/12; 52/16; 52/302; 428/489

[58] Field of Search ..... 428/489, 280; 52/11, 52/12, 16, 302

[56] References Cited

U.S. PATENT DOCUMENTS

| | | | |
|---|---|---|---|
| 3,321,357 | 5/1967 | Kennedy | 428/489 |
| 3,474,625 | 10/1969 | Draper et al. | 428/489 |
| 3,641,216 | 2/1972 | Schnebelen et al. | 260/897 C |
| 3,721,578 | 3/1973 | Bennett et al. | 428/489 |
| 3,909,144 | 9/1975 | Garn et al. | 428/489 |
| 3,950,207 | 4/1976 | Amat | 428/489 |
| 3,953,974 | 5/1976 | Bresson et al. | 428/489 |

*Primary Examiner*—J.C. Cannon

*Attorney, Agent, or Firm*—Price, Heneveld, Huizenga & Cooper

[57] ABSTRACT

Roof drain flashing constituting a tough flexible material bondable to any type roof membrane and capable of accommodating thermal expansion and contraction of the roof without cracking and leaking at the drain, being a layer of nonplasticized chlorinated polyethylene integrally and irreversibly joined to a layer of asphalt-saturated roofing felt. The non-plasticized chlorinated polyethylene is physically joined to the asphalt-saturated felt by pressing the two together at pressures in the 4000 PSI range just subsequent to the CPE being extruded and cooled to the 250° F range, having passed through the extrusion die at considerably higher temperatures.

1 Claim, 2 Drawing Figures

FLASHING ARTICLE COMPRISING A CHLORINATED POLYETHYLENE LAYER ADHERED TO AN ASPHALT-SATURATED FELT LAYER PRODUCED BY JOINING THE TWO LAYERS UNDER PRESSURE AT ELEVATED TEMPERATURE

BACKGROUND OF THE INVENTION

This invention relates to roofing flashing and more particularly to a unique roof drain flashing material.

Conventionally, roof drain flashing materials have for decades been primarily composed of roofing felts hot mopped into the drain body on low cost installations, or of metal such as copper or preferably lead on more costly installations. As is well known, the mopped roofing paper type flashing does not effectively accommodate thermal expansion and contraction for the life of the roof in the critical areas around projections such as drain stacks, where most leakage begins. Metal materials, though heavy and expensive, have thermal accommodation but require periodic remopping of tar over the peripheral portions for resealing because of the lack of a bond of the metal to the adjacent roof membrane material. Periodic remopping necessarily results in a build-up of tar that forms a dam which prevents complete drainage of surrounding roof water. The retained roof water is subject to freezing and the like to create other problems.

In recent years, efforts have been made to develop flashing materials that would not be as expensive as metal and would be superior to impregnated paper. In U.S. Pat. No. 3,641,216 is taught a polymeric material that has flexibility without the necessity of plasticizers so as to not become inflexible like vinyl materials which contain plasticizers and have a high percent of liquids in the compound. This patented material, produced by The Dow Chemical Company, contains no plasticizers, and therefore no nutrient to support growth of fungus, algae or other micro-organisms which would biodegrade the sheet.

CPE sheet has very low temperature flexibility, ability to conform to irregular surfaces, high tensile strength, high elongation, and capacity for solvent welding. If the CPE sheet is simply mopped in unprotected, telegraphic cracks will occur when the asphalt cracks because hot asphalt bonds very well to CPE sheet. When the bitumen cracks it imposes a knife edge stress point or line, and since the bitumen has adhered very tightly to the CPE sheet, the gauge length is O. Thus, even a 500 or 1000% elongation is of no avail because there is no free material to allow for any elongation.

SUMMARY OF THE INVENTION

This invention provides a novel flashing material having the beneficial features of the polymer in U.S. Pat. No. 3,641,216 but with the capacity to be effectively used in exposed installations such as roof drains. The flashing material of this invention is capable of being effectively hot mopped into a bonded relationship with the roofing membrane such as asphalt-saturated felt, capable of being clamped by the clamping collar-gravel guard on a roof drain without cracking or tearing and with inherent capacity to serve as a gasket, and having a lower cost than heavy and cumbersome metal flashing.

The novel flashing has nonplasticized chlorinated polyethylene integrally bonded to asphalt-saturated felt, the two being inseparable, untearable, noncracking, flexible and tough.

DESCRIPTION OF THE PREFERRED EMBODIMENT

Figure 1:
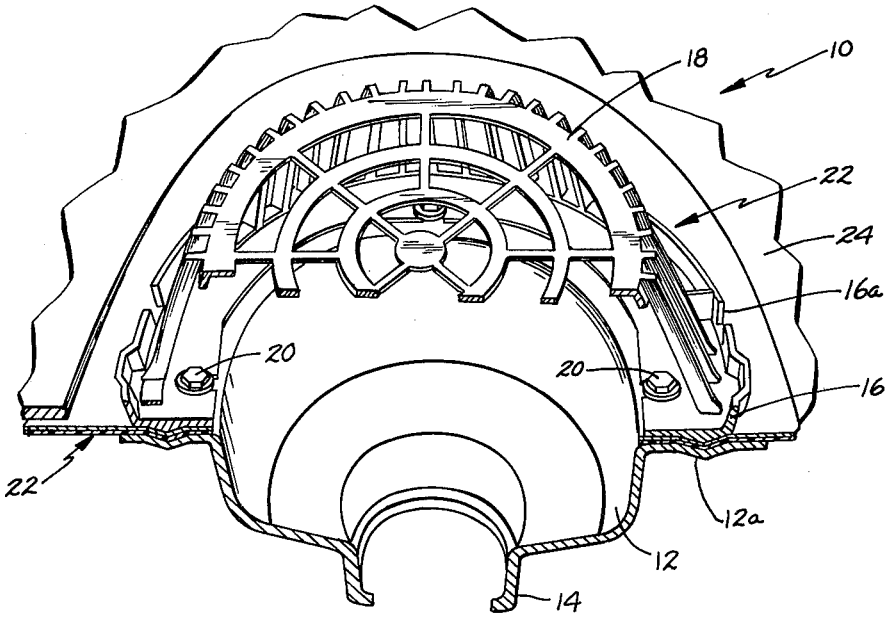
FIG. 1 is a perspective cut-away view of a roof drain installation employing this invention.

The assembly 10 depicted in the drawings includes a roof drain subassembly comprising a drain body member 12 having a lower central throat portion 14 to be mounted on the upper end of a drain stack, a stone guard ring 16, and a perforated dome 18 thereabove. Drain body 12 includes an upwardly, outwardly extending peripheral flange **12*a* having a configurated annular recess in its upper surface. This recess cooperates with a correspondingly configurated annular protrusion on the lower surface of an annular stone guard ring 16. Ring 16 has transverse slots 16*a* in its periphery to allow water passage therethrough. Ring 16 is secured to flange 12*a* of drain body 12 by suitable fasteners such as threaded bolts 20. Secured to ring 16 is the inverted perforated dome 18 extending over the subassembly to prevent large objects from falling into the drain pipe. These components 12, 16 and 18** are of conventional construction.

Figure 2:
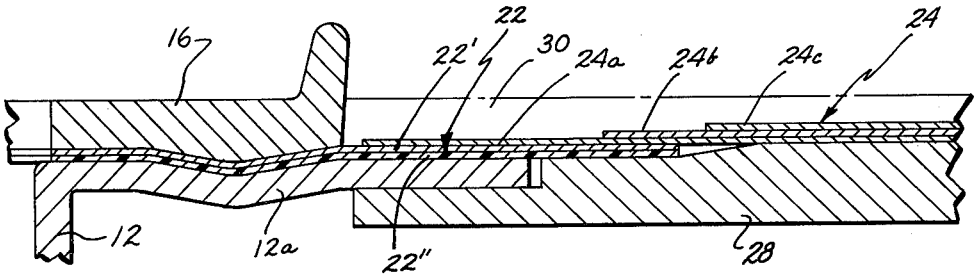
FIG. 2 is a fragmentary, enlarged, sectional view of a portion of the apparatus in FIG. 1.

Clamped between stone guard ring 16 and the flange of drain body element 12, in place of the usual gasket, is the inner peripheral portion of a special integrated flashing element 22 which extends outwardly away from the drain for bonding with the multiple layer (here three in number) membrane 24 (FIG. 2) of the laid-up roof assembly.

The roof may include the typical structural support member 28 on the upper surface of which is the membrane 24 as of conventional asphalt-saturated felt. This membrane 24 is typically composed of several layers **24*a*, 24*b* and 24*c* of saturated felt, with the lowermost layer 24*a* being directly bonded to the upper, outer peripheral surface of flashing element 22. Layers 24*b* and 24*c* are bonded to layer 24*a* in sequence. The flashing and layers are bonded and coated by hot mopping a layer of tar thereon, shown in FIG. 2 in phantom at 30**.

Flashing element 22, rather than being formed of the conventional materials of either asphalt-saturated felt or metal such as lead or copper, is of a special construction. More specifically, it constitutes a unitary structure with an upper zone 22' of asphalt-saturated felt, preferably cotton felt such as that called rag felt, integrally joined to the lower zone 22'' of nonplasticized olefin, and particularly nonplasticized chlorinated polyethylene, the two materials having been pressed together at pressures in the range of about 4000 PSI while the polyethylene is at a temperature in the range of about 250° F. This can be accomplished by passing the two layers of material between pressure rollers just after the polyethylene layer is extruded from a plastic extruder and has cooled to this general temperature range. If pressures significantly above about 4000 PSI are employed, the material is distorted. If pressures below about 4000 PSI are employed, the bond integrating the two materials is not effective enough to be satisfactory. The actual temperature indicated to be in a range about 250° F. must be varied somewhat, depending upon the physical condition of the felt with regard to moisture content. This can be readily determined by trial and error. However, if conditions are controlled within the basic parameters set forth above, the materials are so integrally interbonded and unitized into a single product that it cannot be separated into layers, is tough, flexible and stretchable, capable of 500% elongation with regard to the CPE sheet, and having a tensile strength of about 3000 pounds per square inch. This material, when hot mopped with hot bitumen to the roofing membrane, bonds securely to the roof membrane. The felt can be either a wood, i.e. so-called "fiber" felt or a cotton felt, i.e. so-called "rag" felt, but the latter is preferred since saturation with asphalt can closely approach if not equal 100%, whereas the fiber felt marketed as "saturated" is usually not 100% saturable and contains some undesirable moisture. Therefore rag felt provides the most effective bonding to the CPE. Also, rag felt will not craze and crack like fiber felt. A typical rag felt to use is 20# saturated rag felt.

The flashing element 22 is installed with its polyethylene surface down and its impregnated felt surface up as depicted. The bond between the upper surface of the flashing element and the asphalt-saturated felt roof membrane 24 is a chemical bond as compared to a mere physical bond which occurs between such a roof membrane and the expensive metal flashing used in quality construction heretofore. This effective bonding with this invention greatly extends the useful life of the flashing without requiring constant remopping to reseal the joint. In effect, this development takes advantage of the positive features of saturated felt flashing material without the disadvantages thereof since the saturated felt upper surface of the flashing uniquely acquires the strength and flexibility of the underlying particular polymer such that, although the impregnated felt if used alone as a flashing element tends to shrink, crack and leak, and although the polymer material if used alone could not withstand conditions of weather and telegraphing, the two materials work uniquely together in this unitary structure to exhibit characteristics not possessed by either.

The embodiments of the invention in which an exclusive property or privilege is claimed are defined as follows:

1. Roof drain flashing material characterized by capacity to be hot mopped into a bonded relationship with asphalt-saturated felt roofing membranes, nontearing, noncracking, flexible, and tough, comprising:

nonplasticized chlorinated polyethylene material which has been integrally bonded under elevated temperatures and pressures with asphalt-saturated felt into a unitized, inseparable, stretchable roof drain flashing structure.

* * * * *